US008434391B2

(12) United States Patent
Buchanan

(10) Patent No.: US 8,434,391 B2
(45) Date of Patent: May 7, 2013

(54) HAND OPERATED GRIPPING TOOL

(75) Inventor: Nigel A. Buchanan, Fife (GB)

(73) Assignee: American Grease Stick Company, Muskegon Heights, MI (US)

( * ) Notice: Subject to any disclaimer, the term of this patent is extended or adjusted under 35 U.S.C. 154(b) by 307 days.

(21) Appl. No.: 12/774,227

(22) Filed: May 5, 2010

(65) Prior Publication Data

US 2010/0282033 A1 Nov. 11, 2010

Related U.S. Application Data

(63) Continuation-in-part of application No. 12/261,525, filed on Oct. 30, 2008, which is a continuation-in-part of application No. 12/281,548, filed as application No. PCT/GB2007/000745 on Mar. 5, 2007, now abandoned.

(51) Int. Cl.

| | |
|---|---|
| ***B25B 7/12*** | (2006.01) |
| ***B25B 7/04*** | (2006.01) |
| ***B25B 7/02*** | (2006.01) |
| ***B25B 13/52*** | (2006.01) |
| ***B25B 23/16*** | (2006.01) |
| ***B25G 1/00*** | (2006.01) |

(52) U.S. Cl.

USPC ..... 81/409.5; 81/342; 81/343; 81/309; 81/385; 81/69; 81/68; 81/176.3; 81/177.7; 81/411; 81/413; 81/355

(58) Field of Classification Search ..... 81/409.5, 81/300, 351, 343, 309, 17, 69, 355–357, 81/411, 413, 321–32, 342, 407, 683

See application file for complete search history.

(56) References Cited

U.S. PATENT DOCUMENTS

| | | | |
|---|---|---|---|
| 1,106,518 | A | 8/1914 | Matti |
| 1,508,510 | A | 9/1924 | Edwards |

(Continued)

FOREIGN PATENT DOCUMENTS

| | | |
|---|---|---|
| DE | 871579 | 3/1953 |
| DE | 29816558 | 11/1997 |

(Continued)

OTHER PUBLICATIONS

Search Report for British application Serial No. GB 0908588.7.

(Continued)

*Primary Examiner* — Monica Carter
*Assistant Examiner* — Danny Hong
(74) *Attorney, Agent, or Firm* — Gardner, Linn, Burkhart & Flory, LLP

(57) ABSTRACT

A hand operated gripping tool includes a first jaw fixedly connected with a first jaw handle, a second jaw movable relative to the first jaw such that the first and second jaws cooperably define a variable size space therebetween for receiving a part to be gripped, a second jaw handle pivotally connected with the second jaw for moving the second jaw relative to the first jaw, a link system pivotally connected to the second jaw handle and having a guided portion selectively engageable with a plurality of guide portions provided on the first jaw handle. The guided portion being engageable with a first of the guide portions to define a first range of movement of the second jaw towards the first jaw and a second of the guide portions to define a second range of movement of the second jaw towards the first jaw.

20 Claims, 2 Drawing Sheets

U.S. PATENT DOCUMENTS

| | | | | |
|---|---|---|---|---|
| 1,534,218 | A | 4/1925 | Jones | |
| 1,867,912 | A | 2/1931 | Evey | |
| 2,595,368 | A | 5/1952 | Plautz | |
| 3,222,958 | A | 12/1965 | Houdesheldt | |
| 3,657,949 | A | 4/1972 | Myers | |
| 3,862,776 | A | 1/1975 | Sims et al. | |
| 6,065,376 | A * | 5/2000 | Khachatoorian | 81/407 |
| 6,116,124 | A * | 9/2000 | Ping | 81/385 |
| 7,313,989 | B1 | 1/2008 | Tortolani | |
| 2009/0056510 | A1 | 3/2009 | Buchanan et al. | |
| 2009/0178518 | A1 * | 7/2009 | Buchanan et al. | 81/324 |

FOREIGN PATENT DOCUMENTS

| | | |
|---|---|---|
| GB | 18585 | 10/1901 |
| GB | 844 490 | 1/1958 |
| GB | 2072081 | 9/1981 |
| JP | 09001468 | 6/1995 |

OTHER PUBLICATIONS

International Search Report dated Aug. 6, 2007 for PCT Application Ser. No. PCT/GB2007/000745, which corresponds to U.S. Appl. No. 12/281,548.

Great Britain Search Report for Application No. GB1007513.3, the foreign counterpart to the present application.

* cited by examiner

HAND OPERATED GRIPPING TOOL

CROSS REFERENCE TO RELATED APPLICATIONS

The present application claims priority of UK Application No. 0907673.8, filed May 5, 2009, and UK Application No. 0908588.7, filed May 19, 2009, and the present application is a continuation-in-part of U.S. patent application Ser. No. 12/261,525, filed Oct. 30, 2008, which claims priority of UK Application No. 07 21292.1, filed Oct. 30, 2007, and which is a continuation-in-part of U.S. patent application Ser. No. 12/281,548, filed Sep. 3, 2008, which is a 371 of international Application No. PCT/GB2007/000745, filed Mar. 5, 2007, which claims priority of Ireland Application No. 2006/0158, filed Mar. 3, 2006.

FIELD OF THE INVENTION

The invention relates to hand operated gripping tools. One form of hand operated gripping tool to which the invention is particularly, but not exclusively, applicable is pliers of the type generally referred to as water pump pliers or slip joint pliers.

BACKGROUND TO THE INVENTION

Existing water pump pliers have the common characteristic of jaws offset at an angle to the pliers handles and a pivot post, in the form of a bolt or rivet, mounted in an area rearward of the jaw on one of the handles and projecting through an elongate slot provided in the other handle. Such pliers incorporate means for enabling selective spacing of the distance between the jaws, which may take the form of spaced apart ridges or teeth provided along an inside long edge of the slot and adapted for incremental selective binding engagement with the pivot post. Another known way of providing distance adjustment between the jaws of such pliers is to provide spaced apart arcuate ridges on the facing surfaces of the slot for engagement by the pivot post. All such tools require two-handed operation to adjust the jaw spacing to the size of a workpiece to be gripped between the jaws. This adjustment involves pulling the handles apart to permit the pivot post to slide along the slot to move the movable one of the jaws to a position that provides a jaw spacing approximating to the size of the workpiece that is to be gripped.

SUMMARY OF THE INVENTION

The invention provides a hand operated gripping tool comprising a first jaw fixedly connected with a first jaw handle, a second jaw movable relative to said first jaw such that said first and second jaws cooperably define a variable size space therebetween for receiving a part to be gripped, a second jaw handle pivotally connected with said second jaw for moving said second jaw relative to said first jaw, a link system pivotally connected to said second jaw handle and having a guided portion selectively engageable with a plurality of guide portions provided on said first jaw handle, said guided portion being engageable with a first said guide portion to define a first range of movement of said second jaw towards said first jaw and a second said guide portion to define a second range of movement of said second jaw towards said first jaw.

The invention also includes a hand operating gripping tool comprising a fixed jaw, a movable jaw that is movable with respect to said fixed jaw on a guide member and a linkage system between a handle that is connected with said movable jaw and a fixed part connected with said fixed jaw, said linkage system defining a plurality of discrete user selectable ranges of movement of said movable jaw towards said fixed jaw.

The invention also includes a hand operating gripping tool comprising a fixed jaw, a movable jaw that is movable with respect to said fixed jaw on a guide member and a selector system that is connected between a handle that is connected with said movable jaw and a fixed part connected with said fixed jaw, said selector system being operable to select between a plurality of discrete selectable ranges of movement of said movable jaw towards said fixed jaw.

The invention also includes a method of operating pliers that have a fixed jaw fixedly connected with a fixed jaw handle and a movable jaw that is pivotally connected with a movable jaw handle that is operable to move said movable jaw relative to said fixed jaw to cooperably define a variable size space therebetween for receiving a part to be gripped, said movable jaw handle being provided with a pivotally mounted connecting member that is selectively engageable with a plurality of guide slots provided on said fixed jaw handle to define respective ranges of movement of said movable jaw towards said fixed jaw, said method comprising engaging said connecting member with a selected one of said guide slots to select a desired range of movement of said movable jaw towards said fixed jaw.

The invention also includes pliers comprising:

- a fixed jaw:
- a fixed jaw handle fixedly connected with said fixed jaw by an elongate connecting member, said fixed jaw handle being disposed in a plane;
- a movable jaw mounted on said elongate connecting member;
- a movable jaw handle pivotally connected with said movable jaw and operable to move said movable jaw with respect to said fixed jaw to provide a variable size workpiece gripping space between said fixed and movable jaws, said movable jaw handle being disposed in said plane; and
- a connecting member pivotally connected with said movable jaw handle and having a guide portion that is selectively receiveable in discrete guide openings provided on said fixed jaw handle,
- said guide openings extending in a lengthways direction of said fixed jaw handle and being coupled to define a continuous guide track for said guided portion,
- said guide openings defining respective selectable ranges of movement of said movable jaw towards said fixed jaw,
- said connecting member being disposed in said plane, and
- said connecting member being positioned such as to be operable to move said guided portion along said guide track by a hand that is supporting said pliers by holding said handle.

BRIEF DESCRIPTION OF THE DRAWINGS

In order that the invention may be well understood, an embodiment thereof, which is given by way of example only, will now be described with reference to the drawings in which.

DETAILED DESCRIPTION OF THE ILLUSTRATED EMBODIMENTS

Figure 1:
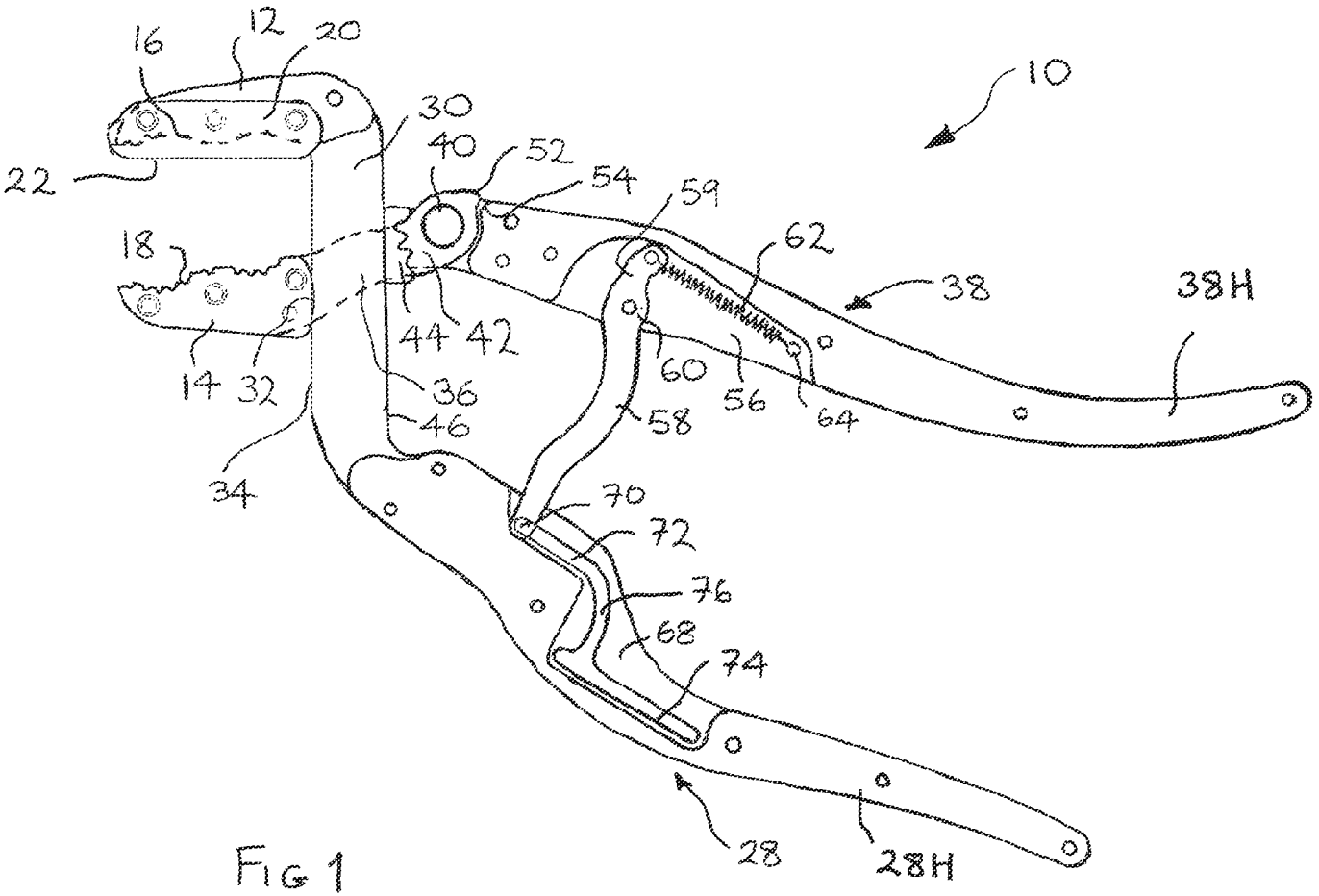
FIG. 1 is a schematic side elevation of a hand operated gripping tool.
Figures 2, 3:
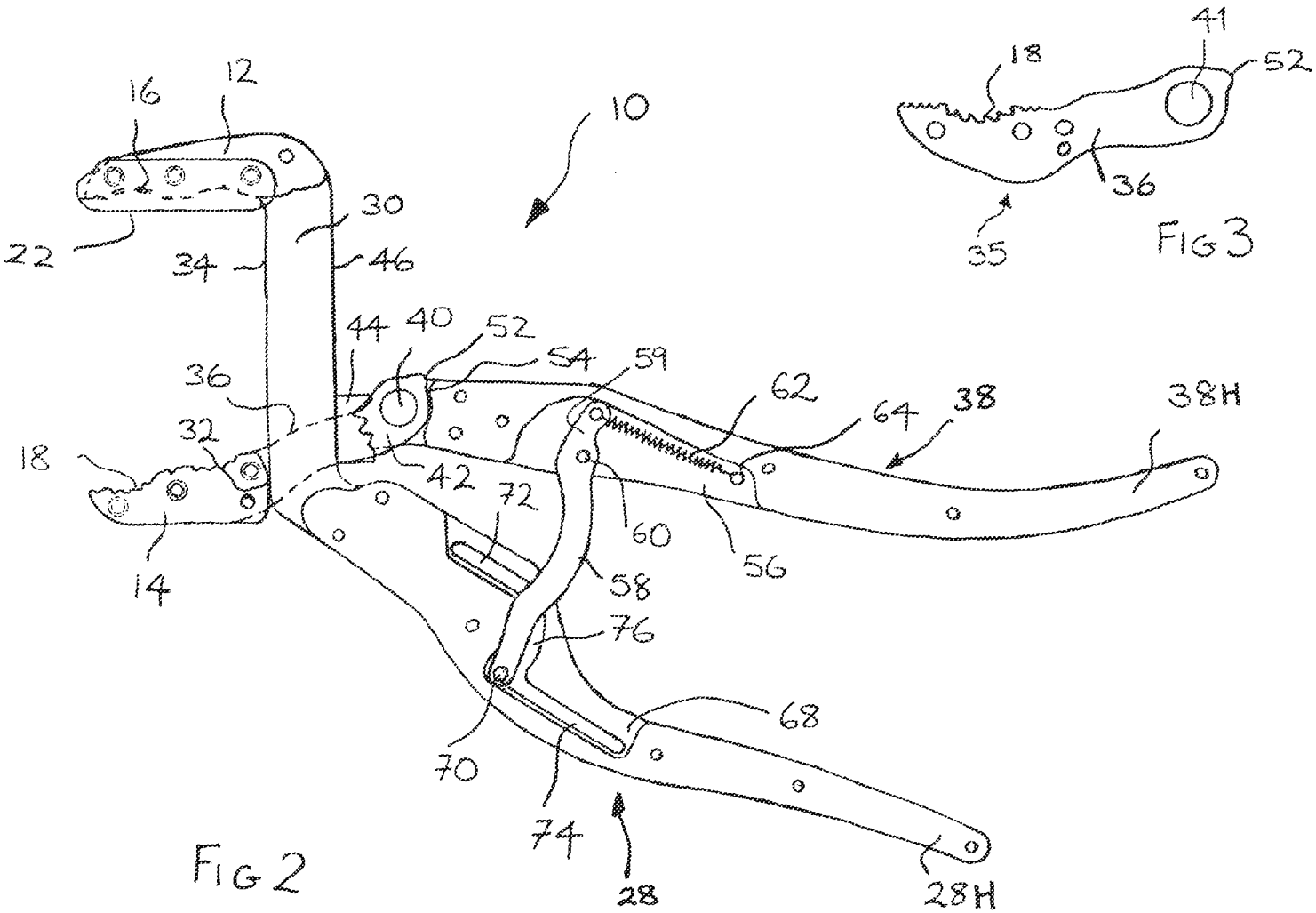
FIG. 2 is a view corresponding to FIG. 1 showing the hand operated gripping tool in a fully open condition.
FIG. 3 shows a side member of a movable jaw of the hand operated gripping tool.

FIGS. 1 and 2 illustrate a hand operated gripping tool in the form of pliers 10. The Figures show the pliers 10 in schematic form with laminations of the pliers removed to allow internal parts of the pliers to be seen. In particular, respective top (as viewed in the drawings) laminations of the pliers handles and movable jaw are not shown. The top lamination of the movable jaw is shown in FIG. 3.

The pliers 10 comprise a fixed jaw 12 and a movable jaw 14. The fixed and movable jaws 12, 14 have oppositely disposed gripping profiles 16, 18 for gripping a workpiece therebetween. The fixed jaw 12 is shown with an optional gripping profile modifier 20 fitted. The gripping profile modifier 20 is a generally U-shaped member that clips onto the fixed jaw 12 in the manner of a shoe and has a gripping profile 22 that is different to the gripping profile 16 of the jaw. In this embodiment, the gripping profile modifier 20 is made of a relatively soft flexible material and has a generally flat gripping profile 22. In this embodiment, the gripping profile modifier 20 is able to clip onto the fixed jaw 12. The face of the gripping profile modifier 20 that is disposed opposite the gripping profile 16 of the fixed jaw 12 is provided with undulations that generally complement the gripping profile 16 so that when the pliers 10 grip a workpiece the gripping modifier 20 should not deform in such a way that the grip on the workpiece might loosen. It will be appreciated that although only one of the jaws 12, 14 is shown fitted with a gripping profile modifier 20, typically where a profile modification is provided, a gripping profile modifier will be fitted to each jaw.

The fixed jaw 12 is fixedly connected with a fixed jaw handle, or lever arm, 28. The fixed jaw 12 is connected with the fixed jaw handle 28 by an elongate connection member 30, which in this embodiment is a generally rectangular member that extends from a rear, or inner, end of the fixed jaw 12 to an inner end of the fixed jaw handle.

The fixed jaw handle 28 is cranked relative to the elongate connection member 30. The fixed jaw handle 28 is preferably cranked relative to the elongate connection member at an angle between 30 and 90 degrees. In the illustrated embodiment, the fixed handle 28 is disposed at approximately 45° to the elongate connection member 30.

The movable jaw 14 is movable along the elongate connection member 30. A rear or innermost end of the movable jaw 14 is shaped to define a cam surface 32. The cam surface 32 is engageable with a earn reaction surface 34 defined by the elongate connection member 30. The movable jaw 14 includes a pair of side members 35 (laminations), one of which is shown in FIG. 3 separate from the pliers 10. As mentioned previously, the uppermost side member 35 (lamination) has been omitted from FIGS. 1 and 2 so that internal parts of the pliers 10 can be seen. The side members 35 are planar laminate members that each comprise a first portion having an outline that includes the gripping profile 18 and a second portion 36 that extends rearwardly of the first portion to a free end that is pivotally connected with a movable jaw handle 38 by means of a pivot pin 40 that is fixed in respective apertures 41 (FIG. 3) defined in the side members. The second portions 36 of the side members 35 are spaced apart to receive the elongate connection member 30 between them with sufficient clearance to allow the movable jaw 14 to be moved along the elongate connection member 30.

The movable jaw handle 38 is pivotable about the pivot pin 40 and is provided with a toothed cam 42 that is fixedly connected with the handle in such a way that it pivots about the pivot pin with the handle. The toothed cam 42 engages teeth of a toothed slip shoe 44 that is disposed in the space between the second portions 36 of the side members 35. The slip shoe 44 .has a generally planar face disposed opposite the toothed side that engages the toothed cam 42 and engages a cam reaction surface 46 defined by the elongate connection member 30. The cam reaction surface 46 is disposed opposite the cam reaction surface 34. The cam reaction surfaces 34, 46 may extend in parallel spaced apart relation or converge towards the fixed jaw 12.

The second portions 36 of the side members 35 define respective stop surfaces 52. The stop surfaces 52 are disposed at the ends of the second portions 36 of the side members 35 adjacent the apertures 41 and are configured to cooperate with a stop surface 54 provided on the movable handle 38 so as to limit the pivoting movement of the movable handle away from the fixed handle 28.

The movable handle 38 is provided with a cavity 56. A link system comprising a link member 58 is pivotally fixed to a pivot pin 60 housed in the cavity 56. The pivot pin 60 passes through the link member 58 at a location adjacent a first end 59 of the link member that is housed in the cavity 56. The cavity 56 additionally houses a bias member, which in this embodiment is a tension spring 62. One end of the tension spring 62 is connected to the first end 59 of the link member 58 and the other is connected to a pin 64 that is fixed to the movable handle 38 within the cavity 56.

The fixed handle 28 is provided with a cavity 68 disposed generally opposite the cavity 56 in the movable handle 38. A second end of the link member 58 is provided with a guide pin 70. The fixed and movable handles 28, 38 are disposed in a common plane and the link member 58 extends between the handles with at least the portions that connect to the handles disposed in that plane.

The guide pin 70 engages a guide track, which in this embodiment is a guide slot defined in the fixed handle 28. The guide pin 70 is received in the guide slot, which comprises a first, inner, lengthways extending portion 72, a second, outer, lengthways extending portion 74 and a connecting portion 76 that connects an outer end of the first portion 72 to an inner end of the second portion 74. As best seen in FIG. 1, each of the first and second portions 72, 74 extends in the lengthways direction of the movable handle 28 and the connecting portion 76 extends transverse to the lengthways direction of the fixed handle 28. In this embodiment, the first and second portions 72, 74 extend serially in parallel with the outer end of the first portion 72 disposed generally opposite the inner end of the second portion 74 and the connecting portion 76 is arcuate to facilitate movement of the pin 70 between the first and second portions. The connecting portion 76 joins the second portion 74 slightly downstream of the end of the second portion that is closest to the elongate connection member 30 and first portion 72. This is so that when the guide pin 70 is positioned at that end of the second portion 74 under the influence of the tension spring 62, it will not tend to be pulled into the connecting portion 76.

The guide pin 70 can be positioned in a selected one of the first and second portions 72, 74 of the guide slot to determine the range of movement of the second jaw 14 relative to the first jaw 12. Referring to FIG. 1, when the guide pin 70 is in the first portion 72 of the guide slot and no force is applied to the handles 28, 38, the tension spring 62 will bias the guide pin to the end of the first portion that is closest to the elongate connection member 30. In this position, the link member 58 positions the movable handle 38 such that the second jaw 14 is positioned furthest from the fixed jaw 12 for a first range of movement of the fixed jaw towards the fixed jaw. This is the position shown in FIG. 1. As explained in more detail below, if a user wishes to close the jaws from this open condition onto a workpiece, the ends of the handles 28, 38 are forced together to move the movable jaw 14 towards the fixed jaw 12.

Referring to FIG. 2, when the guide pin 70 is in the second portion 74 of the guide slot and no force is applied to the handles 28, 38, the tension spring 62 will bias the guide pin to the end of the second portion that is closest to the elongate connection member 30. In this position, the link member 58 positions the movable handle 38 such that the second jaw 14 is positioned furthest from the fixed jaw 12 for a second range of movement of the movable jaw towards the fixed jaw. This is the position shown in FIG. 2 and defines the maximum available opening between the jaws 12, 14. As explained in more detail below, if a user wishes to close the jaws from this open condition onto a workpiece, the ends of the handles 28, 38 are forced together. The closest the second jaw 14 gets to the fixed jaw 12 in the second range of movement approximates to the position shown in FIG. 1, although, some overlap in the two ranges may be provided. A user can set the available range of movement by simply moving the guide pin 70 between the first and second portions 72, 74 of the guide slot via the connection portion 76.

Referring to FIG. 1, when a user wishes to grip a workpiece between the jaws 12, 14 and the workpiece is too large to fit into the spaced defined between the gripping profiles 16, 18 of the jaws 12, 14, the guide pin 70 is moved along the first portion 72 of the guide slot and into the second portion 74 via the connecting portion 76. If the workpiece can be fitted into the space defined between the gripping profiles 16, 18, the user squeezes the handles 28, 38 to move the movable handle 38 towards the fixed handle 28. This movement causes the movable handle 38 to pivot on the pivot pin 60 against the biasing force exerted by the tension spring 62, thereby extending the tension spring. The pivoting movement of the movable handle 38 causes the movable jaw 14 to slide towards the fixed jaw 12 guided by the elongate connection member 30. The pivotal movement of the movable handle 38 about the pivot pin 60 and accompanying sliding movement of the movable jaw 14 continues until movement of the movable jaw is arrested by engagement of the jaws 12, 14 with the workpiece. During this sliding movement of the movable jaw 14, the movable handle 38 does not pivot on the pivot pin 40 and the guide pin 70 remains at the end of the first portion 72 of the guide slot that is nearest to the elongate connection member 30.

Once the jaws 12, 14 engage the workpiece, continued squeezing of the handles 28, 38, causes the guide pin 70 to start moving along the first portion 72 of the guide slot towards the connecting portion 76. This allows the movable handle 38 to pivot about the pivot pin 40. This pivoting movement causes the toothed cam 42 to act on the cam reaction surface 46 via the slip shoe 44. The toothed cam 42 rotates relative to the cam reaction surface 46 so as to push the ends of the second portions 36 of the side members 35 away from the fixed jaw 12 in the general direction of the fixed handle 28. This movement causes the gripping portion of the movable jaw 14 to pivot towards the fixed jaw 12 by causing pivoting of the gripping portion of the movable jaw 14 as the cam surface 32 reacts against the cam reaction surface 34. The relative positions and configuration of the toothed cam 42 and cam surface 32 are such that once the movable handle 38 has pivoted a certain distance around the pivot pin 40 a considerable torque is applied to the workpiece whilst a reduced force needs to be applied to the handles 28, 38 to maintain the grip on the workpiece. This caroming arrangement is described in greater details in the Applicant's copending US Patent Application published as US2009/0056510, the content of which is incorporated herein by reference.

As previously described, if the workpiece to be gripped cannot fit into the maximum space allowed between the jaws 12, 14 for the first range of movement, the user moves the guide pin 70 into the second portion 74 of the guide slot via the connecting portion 76. In the absence of a force applied to the handles 28, 38, the tension spring biases the pliers 10 to the fully open condition shown in FIG. 2. Starting from that position, the process for causing the jaws 12, 14 to grip on the workpiece is the same as that just described with reference to FIG. 1.

It will be appreciated that the guide track is provided adjacent a hand gripping portion 28H of the fixed handle 28 such that such that a user can move the guide pin 70 between the guide portions 72, 74 by a one handed action by a hand that is holding the tool by the hand gripping portions 28H, 38H of the handles 28, 38.

The provision of the two ranges of movement for the movable jaw 14 allows the pliers 10 to be configured such that the orientation of the handles 28, 38 at the start position for each range (the positions shown in FIGS. 1 and 2) is similar, or the same, and the spacing between them is not excessive. If there were not a second portion of the guide track and the guide pin 70 had to be positioned in the first portion with the jaws in the fully open position shown in FIG. 2, the movable handle 38 would be inclined away from the fixed handle 28 such that the space between the free ends of the handles would be excessive. This would make operation of the pliers, particularly one-handed operation, difficult or impossible and/or limit the maximum size of opening between the jaws that could usefully be provided. The illustrated embodiment makes possible a significantly greater range of movement of the movable jaw relative to the fixed jaw while retaining ease of operation for the user.

It will be understood that in the embodiment the fixed and movable handles 28, 38 extend approximately in parallel when at the respective starting positions of the two movement ranges. However, this is not essential and the above described advantages are achievable absent strict, or approximate, parallelism.

It will be appreciated that providing pliers with a range selector system comprising the linkage system of the illustrated embodiment makes it possible to provide a relatively large available movement of the movable jaw with respect to the fixed jaw by dividing that movement into a plurality of smaller movement ranges in a way that allows the handles to be positioned for the start of each of the smaller movement ranges such that an average user can operate the handles with one hand.

It will be appreciated that other forms of pivoting and cam mechanism could be provided for the pliers 10 in accordance with the disclosure of US2009/0056510. For example, it is not necessary to have a toothed cam and slip shoe and instead the movable handle could be provided with a cam surface that bears directly on the cam reaction surface as shown, for example, in FIGS. 10 to 12 of U.S.2009/0056510.

It will be understood that the link member 58 could be provided with a lock portion forming a part of a locking system in the way shown in FIGS. 17 to 19 of US2009/0056510.

It will be understand that in addition to, or as an alternative to modifying the gripping profile, the gripping profile modifier may be made of a relatively soft material, such as a plastics material, to provide a 'soft jaw' option for the pliers.

It will be understood that the fixed handle of the hand operated gripping tool may be omitted in accordance with the disclosure of US2009/0056510 and the guide for the link member provided in a part that is fixed relative to the movable handle.

What is claimed is:

1. A hand operated gripping tool comprising:

a first jaw fixedly connected with a first jaw handle;

a second jaw movable relative to said first jaw such that said first and second jaws cooperably define a variable size space therebetween for receiving a part to be gripped;

a second jaw handle pivotally connected with said second jaw and operable to cause sliding movement of said second jaw relative to said first jaw; and a link system pivotally connected to said second jaw handle and having a guided portion selectively engageable with a guide slot provided on said first jaw handle, said guided portion being engageable with a first portion of said guide slot to define a first range of said sliding movement of said second jaw towards said first jaw and being engageable with a second portion of said guide slot to define a second range of said sliding movement of said second jaw towards said first jaw, wherein said first and second portions of said guide slot are offset and connected by a connecting portion of said guide slot.

2. A tool as claimed in claim 1, wherein said guide slot is provided with a connecting portion that extends transversely of and connects said first and second portions of said guide slot to define a guide track for said guided portion.

3. A tool as claimed in claim 2, wherein said first and second portions of said guide slot extend in a lengthways direction of said first jaw handle and said connecting portion extends from an end region of said first portion disposed furthest from said first jaw to an end region of said second portion disposed nearest to said first jaw.

4. A tool as claimed in claim 2, wherein said connecting portion arches towards a free end of said first jaw handle.

5. A tool as claimed in claim 1, comprising a bias member connected between said second jaw handle and said link system for biasing said second jaw to respective start positions of said first and second ranges of movement at which start positions said second jaw is disposed furthest from said first jaw for the respective ranges of movement.

6. A tool as claimed in claim 1, comprising an elongate member connecting said first jaw with said first jaw handle, said sliding movement of said second jaw being along said elongate member and said first jaw handle being disposed at an angle substantially between 30 and 90 degrees to said elongate member.

7. A tool as claimed in claim 6, wherein said second jaw handle is provided with a second jaw handle cam arranged for reacting against a first cam reaction surface defined by said elongate member in response to movement of said second jaw handle towards said first jaw handle and said second jaw is provided with a cam surface arranged for reacting against a second cam reaction surface defined by said elongate member in response to reaction of said second jaw handle cam with said first cam reaction surface, reaction of said cam surface with said second cam reaction surface causing a pivoting movement of said second jaw towards said first jaw.

8. A tool as claimed in claim 1, wherein said second jaw is pivotable relative to said second jaw handle on a pivot mounting provided at an end of said second jaw handle.

9. A tool as claimed in claim 1, wherein said first and second portions of said guide slot are disposed serially along said first jaw handle in generally parallel spaced relation.

10. A tool as claimed in claim 1, wherein said ranges of movement overlap.

11. A tool as claimed in claim 1, wherein in said first range of movement said second jaw is movable between a maximum open condition of said jaws and a position intermediate said maximum open condition and a minimum open condition and in said second range of movement said second jaw is movable between a position intermediate said maximum open condition and said minimum open condition and said minimum open condition.

12. A tool as claimed in claim 1, wherein orientations of said first jaw handle and said second jaw handle at respective start positions of said ranges of movement are substantially the same.

13. A tool as claimed in claim 12, wherein said first jaw handle and said second jaw handle extend in generally parallel spaced apart relation at said respective start positions.

14. A tool as claimed in claim 1, wherein said first and second jaw handles each comprise a hand gripping portion and said plurality of guide slot is disposed adjacent said hand gripping portion of said first jaw handle such that a user can move said guided portion between said first and second portions of said guide slot by a one handed action by a hand that is holding said tool by said hand gripping portions.

15. A tool as claimed in claim 1, wherein said first and second portions of said guide slot are configured such that in use said guided portion is movable along the first or second portion of said guide slot with which it is engaged in response to a reaction force produced by said first and second jaws gripping a said part to be gripped.

16. A tool as claimed in claim 1, wherein said first and second jaw handles are disposed in a plane and said link system extends between said first and second jaw handles in said plane.

17. Pliers comprising:

a fixed jaw;

a fixed jaw handle fixedly connected with said fixed jaw by an elongate connecting member, said fixed jaw handle being disposed in a plane;

a movable jaw mounted on said elongate connecting member so as to be slidable along said elongate connecting member;

a movable jaw handle pivotally connected with said movable jaw and operable to cause said sliding movement of said movable jaw to provide a variable size workpiece gripping space between said fixed and movable jaws, said movable jaw handle being disposed in said plane;

a connecting member pivotally connected with said movable jaw handle and having a guided portion that is selectively receiveable in discrete guide openings provided on said fixed jaw handle;

said guide openings extending in a lengthways direction of said fixed jaw handle and being offset and coupled to define a continuous guide track for said guided portion;

said guide openings defining respective selectable ranges of sliding movement of said movable jaw towards said fixed jaw;

said connecting member being disposed in said plane; and said connecting member being positioned such as to be operable to move said guided portion along said guide track by a hand that is supporting said pliers by holding said handles.

18. A method of operating pliers that have a fixed jaw fixedly connected with a fixed jaw handle and a movable jaw that is pivotally connected with a movable jaw handle that is operable to cause sliding movement of said movable jaw relative to said fixed jaw to cooperably define a variable size space therebetween for receiving a part to be gripped, said movable jaw handle being provided with a pivotally mounted connecting member that is selectively engageable with a plurality of discrete elongate portions of a guide slot provided on said fixed jaw handle that define respective ranges of sliding movement of said movable jaw towards said fixed jaw, wherein said elongate portions of said guide slot are offset and connected by a connecting portion of said guide slot, said method comprising engaging said connecting member with a selected one of said elongate portions of said guide slot to select a desired said range of sliding movement of said movable jaw towards said fixed jaw.

19. A method as claimed in claim 18, comprising holding said handles in a hand and operating said connecting member by means of said hand while holding said handles.

20. A tool as claimed in claim 1, wherein said link system comprises an elongate connecting member having a first end and a second end and said elongate connecting member and a pivot pin provided on said second jaw handle engages said elongate connecting member at a location adjacent said first end and said guided portion comprises a guide pin provided at said second end.

* * * * *

UNITED STATES PATENT AND TRADEMARK OFFICE

CERTIFICATE OF CORRECTION

PATENT NO. : 8,434,391 B2
APPLICATION NO. : 12/774227
DATED : May 7, 2013
INVENTOR(S) : Nigel A. Buchanan It is certified that error appears in the above-identified patent and that said Letters Patent is hereby corrected as shown below:

In the Specification

Column 3
Line 51, “earn” should be --cam--

Column 6
Line 2, “caroming” should be --camming--

Signed and Sealed this
Twenty-fourth Day of December, 2013

Margaret A. Focarino

Margaret A. Focarino
*Commissioner for Patents of the United States Patent and Trademark Office*